US011338466B2

(12) United States Patent
Falk et al.

(10) Patent No.: US 11,338,466 B2
(45) Date of Patent: May 24, 2022

(54) ARRANGEMENT FOR REPLACING A SAW CHAIN ON A MOTOR SAW

(71) Applicant: JPS TEKNIK AB, Färila (SE)

(72) Inventors: Curt Falk, Hudiksvall (SE); Peter Sörell, Färila (SE); Torbjörn Gustafsson, Korskrogen (SE)

(73) Assignee: JPS TEKNIK AB, Färila (SE)

( * ) Notice: Subject to any disclaimer, the term of this patent is extended or adjusted under 35 U.S.C. 154(b) by 65 days.

(21) Appl. No.: 16/617,203

(22) PCT Filed: Jun. 4, 2018

(86) PCT No.: PCT/SE2018/050578
§ 371 (c)(1),
(2) Date: Nov. 26, 2019

(87) PCT Pub. No.: WO2018/222131
PCT Pub. Date: Dec. 6, 2018

(65) Prior Publication Data

US 2021/0129371 A1 May 6, 2021

(30) Foreign Application Priority Data

Jun. 2, 2017 (SE) ..... 1700111-6

(51) Int. Cl.
*B27B 17/02* (2006.01)
*B27B 17/14* (2006.01)

(52) U.S. Cl.
CPC ..... *B27B 17/02* (2013.01); *B27B 17/14* (2013.01)

(58) Field of Classification Search
USPC ..... 30/386
See application file for complete search history.

(56) References Cited

U.S. PATENT DOCUMENTS 2,765,821 A * 10/1956 Strunk ..... B27B 17/14 30/386
4,819,332 A * 4/1989 Sugihara ..... B27B 17/02 30/123.4

(Continued)

FOREIGN PATENT DOCUMENTS

EP 2848828 A1 3/2015
GB 539956 * 9/1941

OTHER PUBLICATIONS

International Search Report issued in PCT/SE2018/050578 dated Jun. 28, 2018 (5 pages).

(Continued)

*Primary Examiner* — Hwei-Siu C Payer
(74) *Attorney, Agent, or Firm* — Tucker Ellis LLP

(57) ABSTRACT

The present invention refers to a motor saw arrangement comprising a support plate attached to the motor saw chassis or motor saw motor, a detachable clamping plate and a detachable guide bar arranged between the support plate and the clamping plate. The support plate is provided with two first recesses and at least one threaded hole, while the clamping plate is provided with two protrusions adapted to fit inside the respective two first recesses when the clamping plates is attached to the support plate and the protrusions each have a height that exceeds a corresponding height of the guide bar. The guide bar is provided with two keyhole-shaped slots and with a longitudinal slit between the two keyhole-shaped slots and the support plate is further provided with an alignment means. The invention further relates to a method to remove and/or replace a saw chain from a guide bar and to a guide bar intended and adapted for the motor saw arrangement described herein.

12 Claims, 8 Drawing Sheets

(56) References Cited

Figure 1:
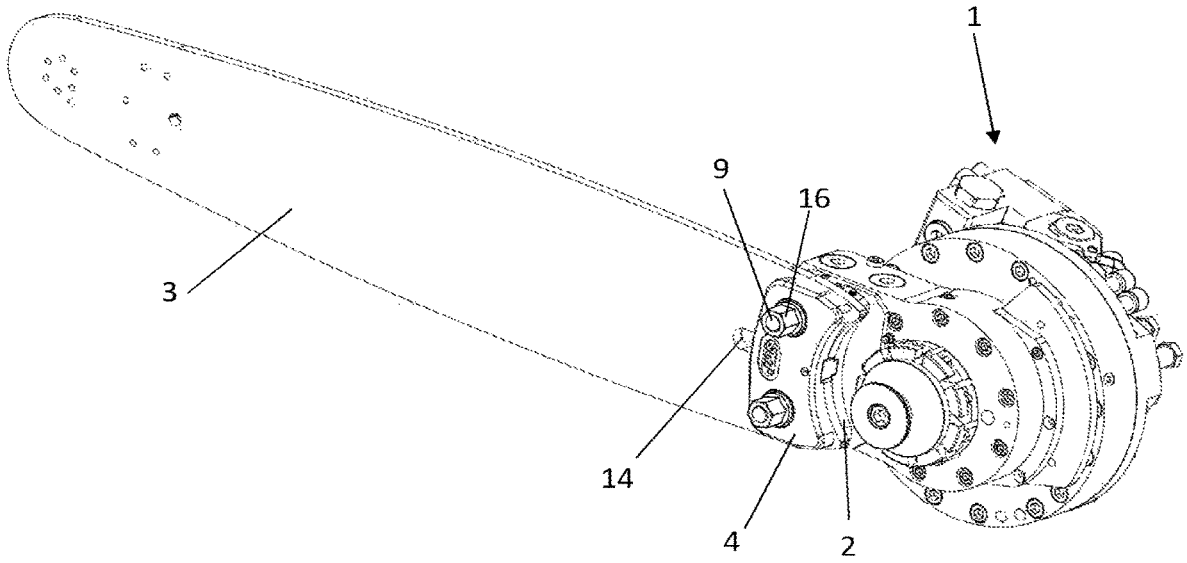

U.S. PATENT DOCUMENTS 5,353,506 A * 10/1994 Muller ..... B27B 17/02 30/383
5,709,254 A * 1/1998 Argue ..... A01G 23/091 144/336
5,896,670 A * 4/1999 Gibson ..... B27B 17/14 30/386
5,983,508 A * 11/1999 Sundstrom ..... B27B 17/14 30/383
5,987,786 A 11/1999 Gibson et al.
6,345,447 B1 * 2/2002 Ronkko ..... B27B 17/14 30/383
6,694,623 B1 * 2/2004 Haughey ..... B27B 17/14 30/386
7,287,330 B1 * 10/2007 Riha ..... B27B 17/14 30/381
8,132,484 B2 * 3/2012 Pfleiderer ..... B27B 17/02 74/606 R
8,136,256 B2 * 3/2012 Wolf ..... B27B 17/02 30/383
8,615,890 B2 * 12/2013 Wolf ..... B27B 17/02 30/383
9,573,208 B2 * 2/2017 Takayanagi ..... B23D 57/023
2003/0024129 A1 * 2/2003 Franke ..... B27B 17/00 30/386
2006/0075644 A1 * 4/2006 Keeton ..... B27B 17/14 30/386
2010/0088905 A1 * 4/2010 Pellenc ..... B27B 17/14 30/386
2011/0232110 A1 9/2011 Guenter et al.
2015/0068048 A1 * 3/2015 Yoneyama ..... B27B 17/00 30/383
2015/0089820 A1 * 4/2015 Sorell ..... A01G 23/091 30/383
2016/0039110 A1 * 2/2016 Schiedt ..... B27B 17/14 30/386
2016/0052158 A1 * 2/2016 Luedtke ..... B27B 17/02 30/383
2021/0129371 A1 * 5/2021 Falk ..... B27B 17/14

OTHER PUBLICATIONS

Written Opinion issued in PCT/SE2018/050578 dated Jun. 28, 2018 (6 pages).

* cited by examiner

ARRANGEMENT FOR REPLACING A SAW CHAIN ON A MOTOR SAW

CROSS-REFERENCE TO RELATED APPLICATIONS

The present invention is filed under 35 U.S.C. § 371 as the U.S. national phase of International Patent Application No. PCT/SE2018/050578, filed on 4 Jun. 2018, which designated the United States and claims priority to Swedish Patent Application No. 1700111-6, filed on 2 Jun. 2017, each of which is hereby incorporated in its entirety including all tables, figures and claims.

The present invention refers to an arrangement for replacing or removing a saw chain from a motor saw. It further relates to a method of removing and/or replacing a saw chain from a guide bar in the motor saw arrangement and to a guide bar intended and adapted for use in the motor saw arrangement.

The saw chain is provided on a guide bar of a motor saw. The guide bar has a channel along its entire circumferential wherein a saw chain runs. Both the guide bar and the saw chain of a motor saw is exposed to wear and need to be replaced or removed regularly. A saw chain is used during long hours and can be sharpened when necessary. The saw chain will also be removed and replaced regularly. There is a wear in each drive link which with time will increase the length of the saw chain. It is therefore necessary to be able to increase the tension of the saw chain to keep the saw chain in a fully stretched state. If the saw chain is not tensioned enough it can accidently fall out of the channel of the guide bar of the motor saw, which will cause unwanted downtime for the motor saws.

There are several types of devices for automatic tensioning of the saw chain on the market. For reasons of lack of space, it is important that the arrangement for tensioning the chain extends as little as possible in the lengthwise direction of the guide bar.

There are mainly two chain types in the market for motor saws, chains with a pitch of 0.404", which is the smaller chain with a shorter drive link distance, and chains with a pitch of ¾", which is the more robust and powerful chain with a larger drive link distance.

One problem with the motor saws and motor saw arrangement on the market today is that it is hard to design the guide bars with a unitary design of the attachment arrangement for both types of chains and for different sizes of motor saws.

It is known to have a clamping plate and a support plate for attaching a guide bar to a motor saw motor unit. This has for example been described in GB 539956 and in WO 2013/165294. However, none of the known products having a guide bar arranged between a clamping plat and a support plate gives the possibility to displace the guide bar enough for a saw chain having a larger pitch, without completely removing any parts.

The present inventors have found that there is a need for a guide bar and an arrangement for mounting and tensioning a saw chain on the guide bar of a motor saw, which arrangement can be used for different types of chains and guide bars. Since these products are mainly used in hard terrain it is important that any replacing or removing of both the guide bar and the saw chain can be done without completely removing any parts, since the removal of parts increases the risk that parts are lost in the terrain.

One object of the present invention is therefore a motor saw arrangement comprising a support plate attached to the motor saw chassis or motor saw motor, a detachable clamping plate and a detachable guide bar arranged between the support plate and the clamping plate. The support plate is provided with two first recesses and at least one threaded hole, while the clamping plate is provided with two protrusions adapted to fit inside the respective two first recesses when the clamping plates is attached to the support plate and the protrusions each have a height that exceeds a corresponding height of the guide bar. The guide bar is provided with two keyhole-shaped slots and with a longitudinal slit between the two keyhole-shaped slots and the support plate is further provided with an alignment means.

A further object of the invention is a motor saw arrangement as described above, in which the motor saw arrangement is further provided with at least one fastening means to press the clamping plate towards the support plate with the guide bar between them.

A further object of the invention is a motor saw arrangement as described above, in which the clamping plate is further provided with a spring means arranged to push the clamping plate away from the support plate when the at least one fastening means is partially loosened.

Another object of the invention is a motor saw arrangement as described above, wherein in that the clamping plate is further provided with a spring means, arranged to push the clamping plate away from the support plate when the at least one fastening means is partially loosened. The spring means is preferably a compression spring and is preferably arranged between the two protrusions.

Still another object of the present invention is a motor saw arrangement according to what has been described above, wherein the fastening means is a clamping bolt and in that the motor saw arrangement is further provided with at least one clamping bolt nut, arranged to achieve said pressing together of the support plate to the clamping plate.

Another object of the invention is a motor saw arrangement as described above, wherein the support plate is provided with at least two fastening means arranged in the middle of each first recess. The fastening means may be a threaded bolt and the arrangement may further comprise threaded nuts to achieve said pressing together of the support plate to the clamping plate with the guide bar between them.

Another object of the invention is a motor saw arrangement as described above, wherein the alignment means on the support plate is a raised, longitudinally oriented, rectangular projection between the two first recesses and in that a further alignment means is provided on the clamping plate to receive the raised rectangular projection once the clamping plate is attached to the support plate. The alignment means may further engage with the longitudinal slit on the guide bar, to adjust the guide bar in its lengthwise direction.

Another object of the invention is a motor saw arrangement as described above, wherein the alignment means engages with a spring means to achieve a raised position for the clamping plate when fastening means are partly loosened.

A further object of the invention as a method to remove and/or replace a saw chain from a guide bar in a motor saw arrangement according to any of the preceding claims, which method comprises the following steps:

a. partially detaching a clamping plate from the motor saw arrangement to release the guide bar; and b. displacing the guide bar in its longitudinal direction towards a driving sprocket on a motor saw motor unit c. detaching the saw chain from the guide bar.

The method can further comprise a step of:

d. displacing the guide bar further towards the driving sprocket, which displacement for example can be achieved by a hydraulic chain stretcher.

Figure 2A:
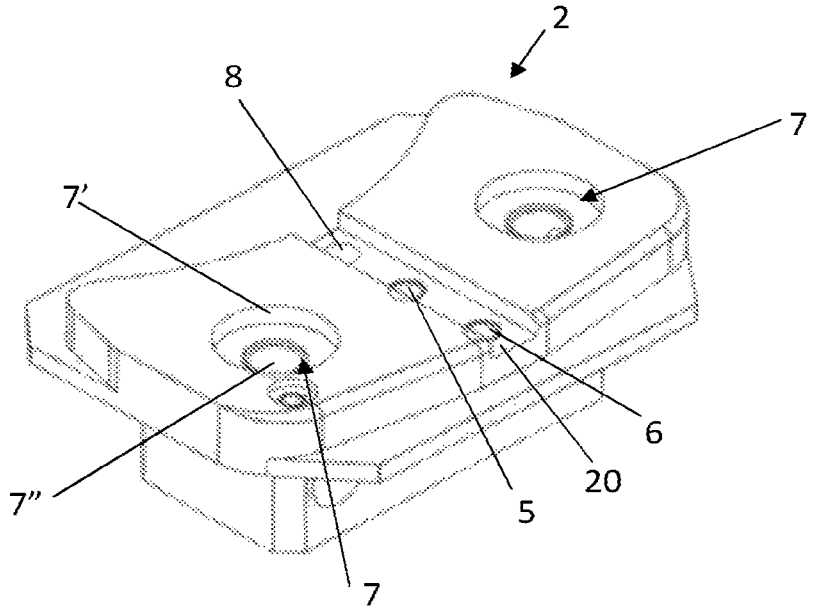
Figure 2B:
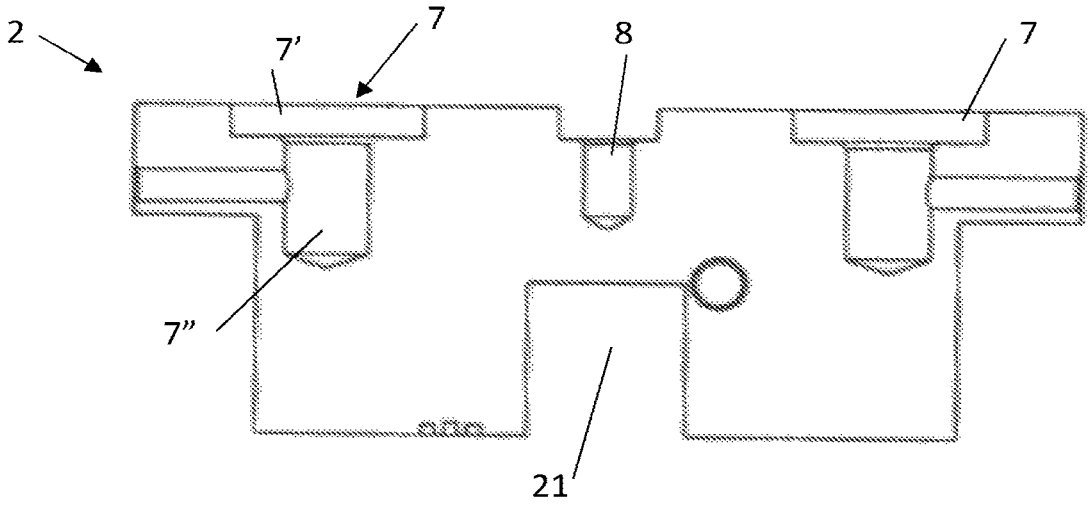
Figure 3:
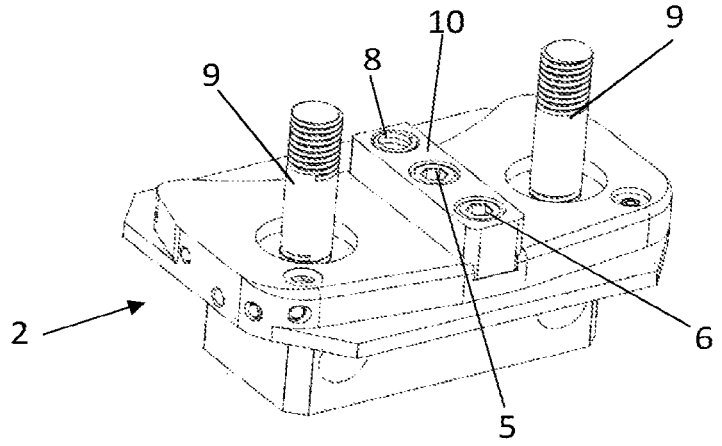
Figure 4:
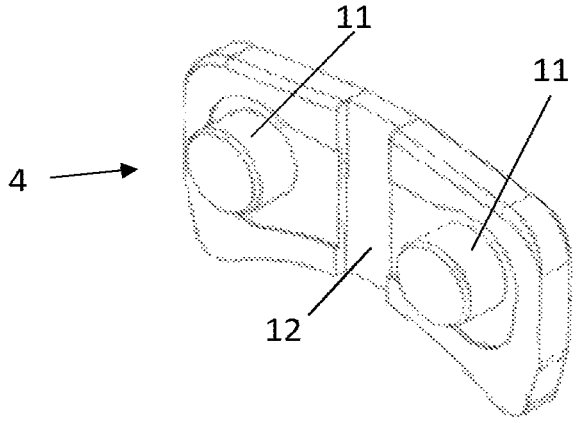
Figure 5:
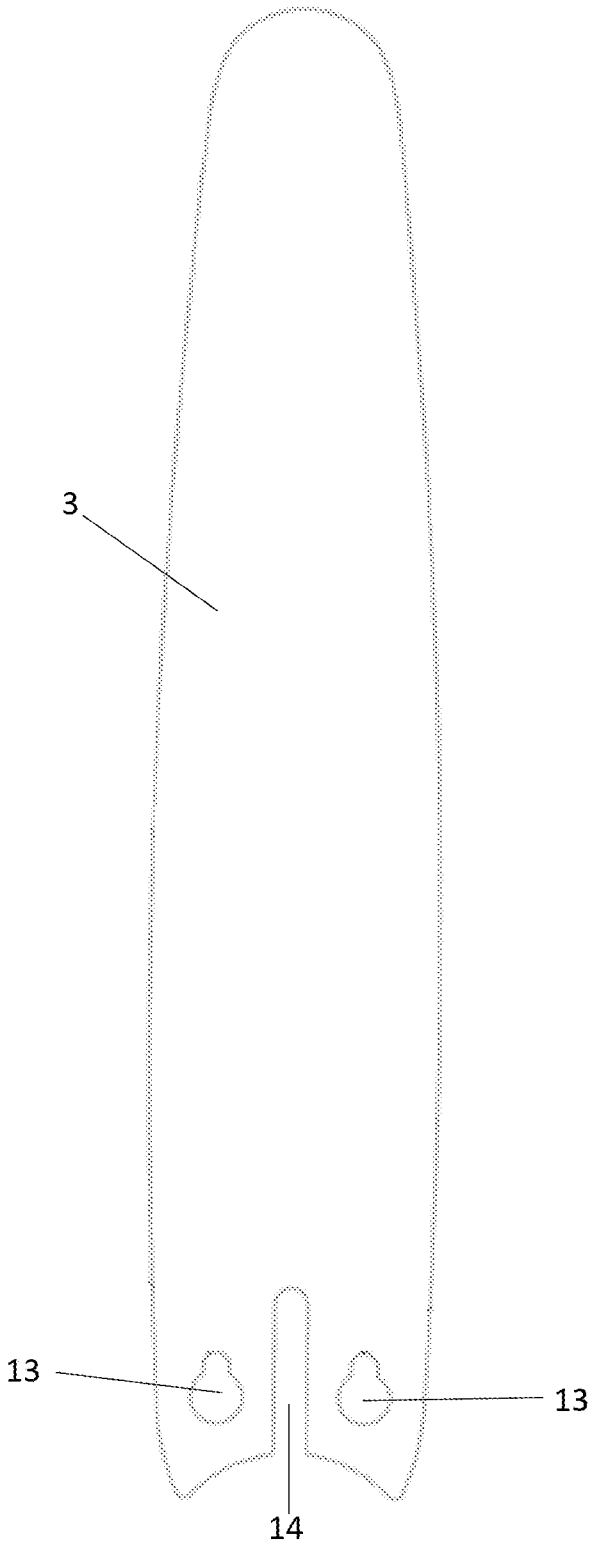
Figure 6A:
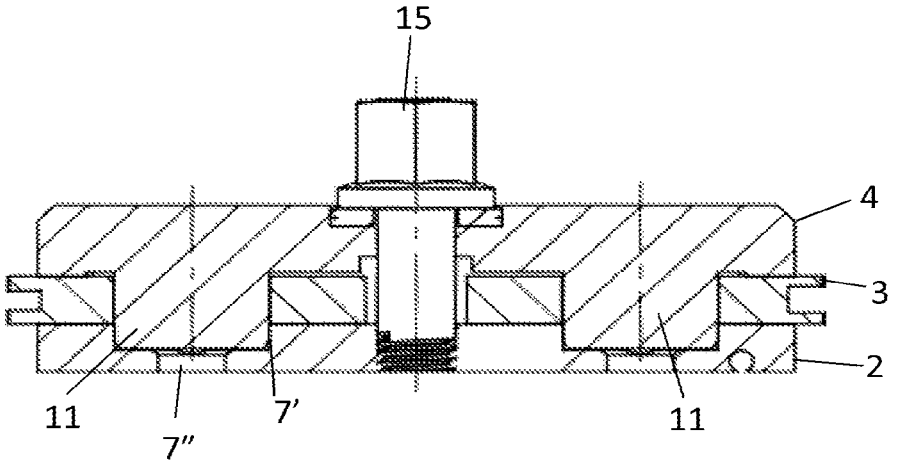
Figure 6B:
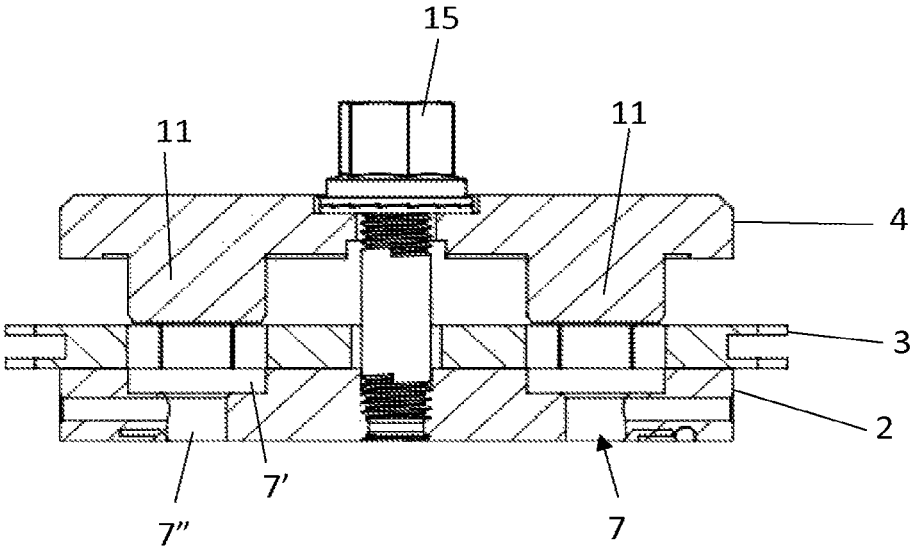
Figure 7A:
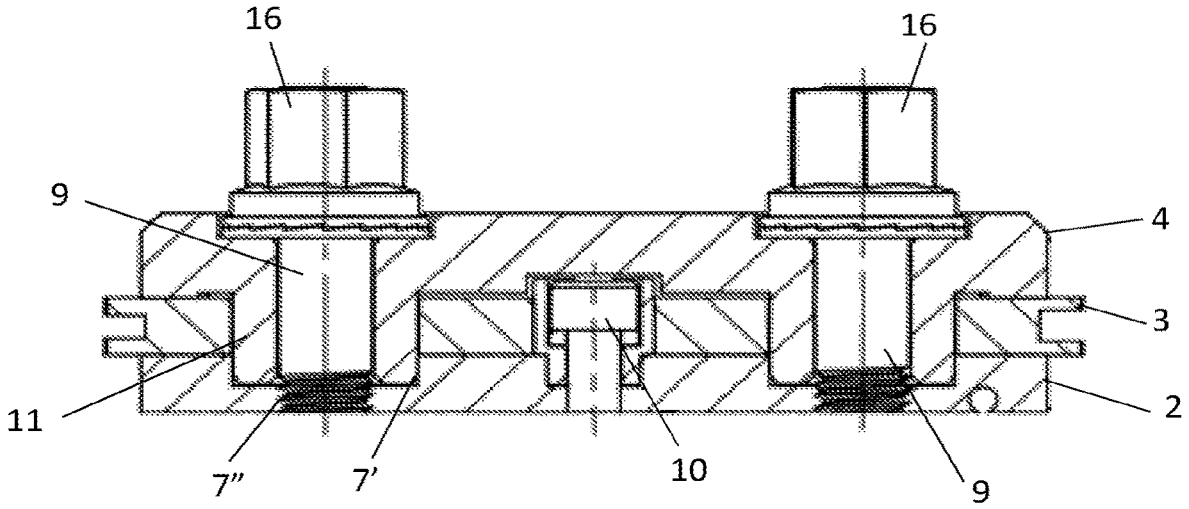
Figure 7B:
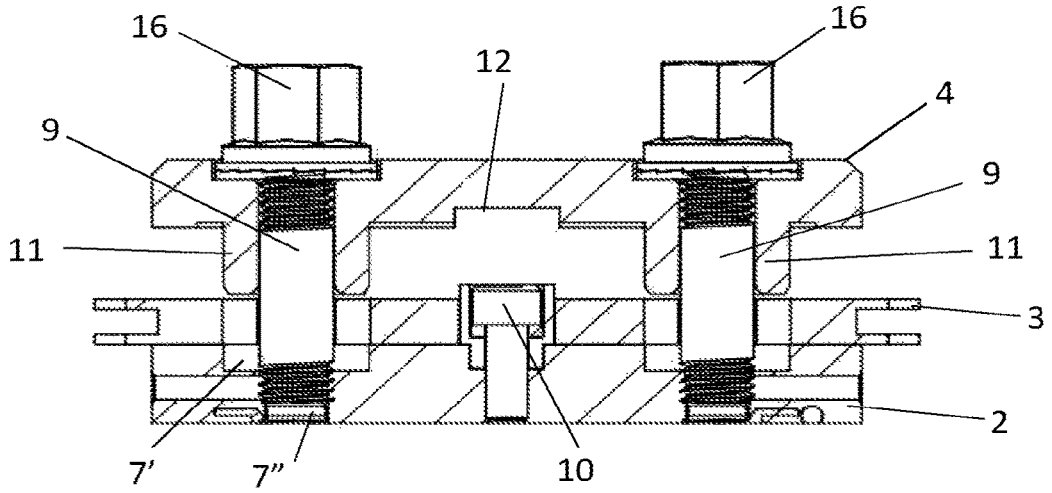
Figure 7C:
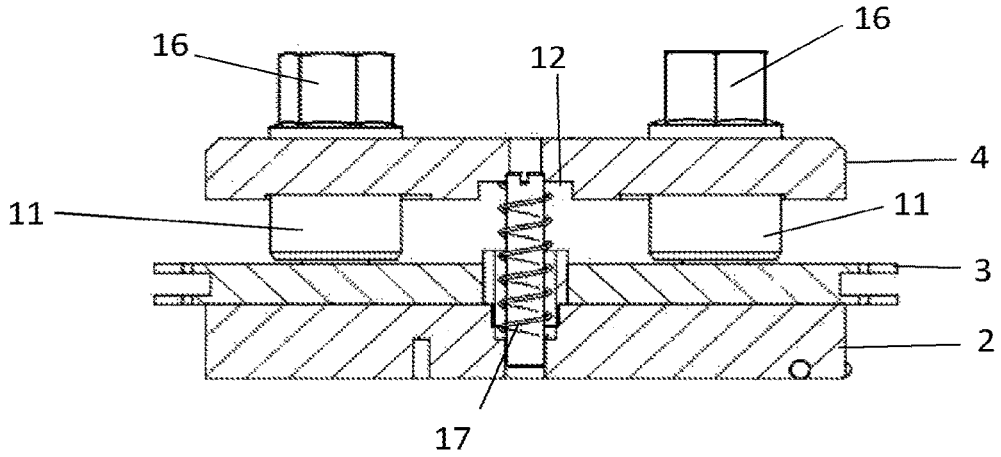

In the following, the invention will be described in detail, with reference to exemplifying embodiments of the invention and to the enclosed drawings, in which:

FIG. 1 shows a perspective view of a motor saw with the arrangement for replacing a guide bar attached to the motor saw FIG. 2A shows a perspective view of a first embodiment of the support plate FIG. 2B shows a cross-sectional view of a first embodiment of the support plate the support plate FIG. 3 shows a perspective view of a second embodiment of the support plate FIG. 4 shows a perspective bottom view of the clamping plate FIG. 5 shows a side view of a guide bar FIG. 6A shows a cross sectional view of the arrangement for replacing a guide bar in a clamped position, with the support plate according to a first embodiment FIG. 6B shows a cross sectional view of the arrangement for replacing a guide bar in an open position, with the support plate according to a first embodiment FIG. 7A shows a cross sectional view of the arrangement for replacing a guide bar in a clamped position, with the support plate according to a second embodiment FIG. 7B shows a cross sectional view of the arrangement for replacing a guide bar in an open position, with the support plate according to a second embodiment FIG. 7C a cross sectional view of the arrangement for replacing a guide bar in an open position, with the support plate according to a second embodiment and with a spring means attached to the clamping plate.

Figure 8A:
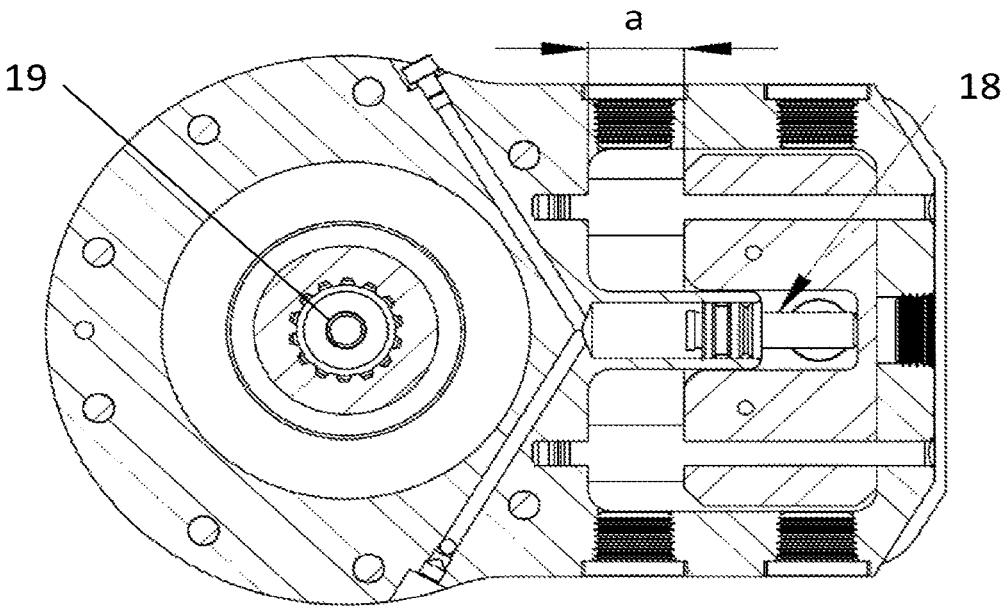
Figure 8B:
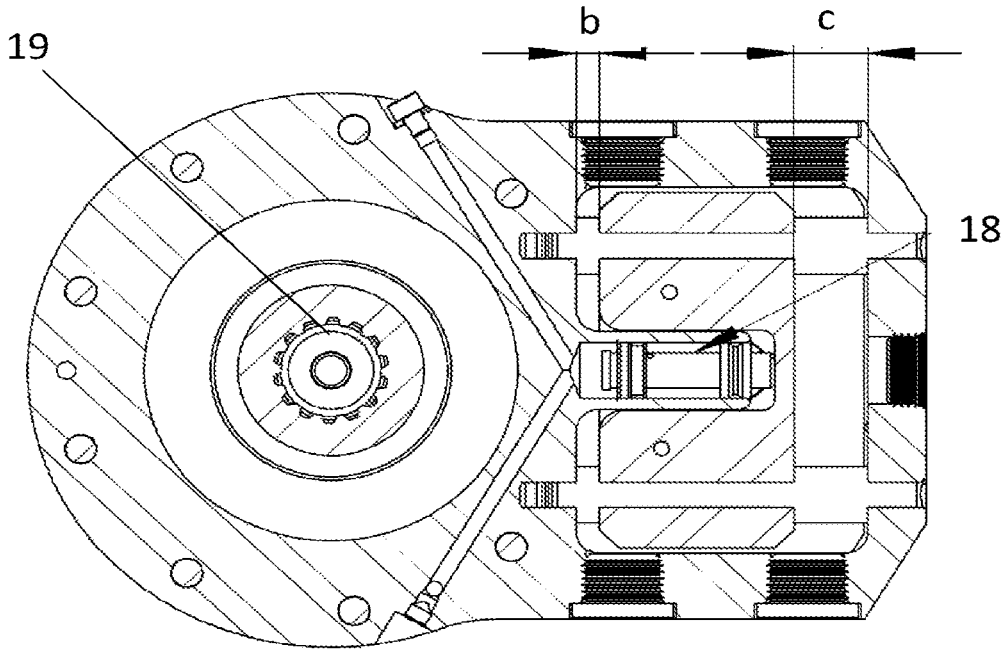
Figure 9:
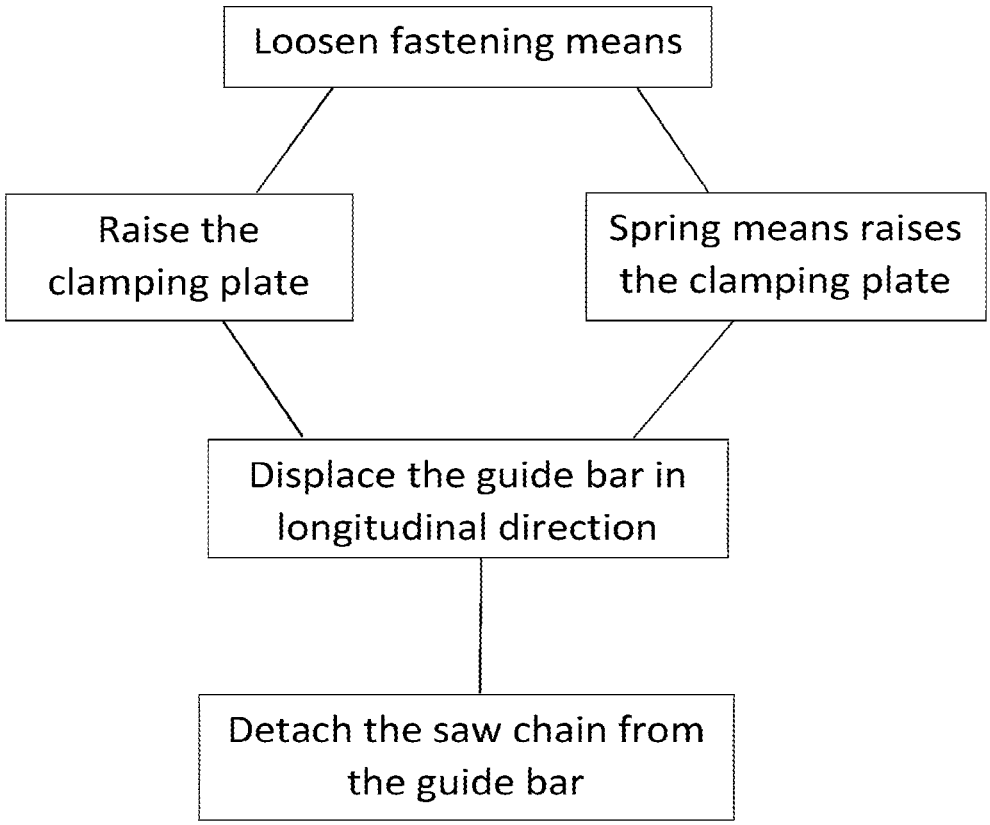

FIG. 8A shows a cross-sectional view of the motor of a motor saw, with a hydraulic piston in a first position FIG. 8B shows a cross-sectional view of the motor of a motor saw, with a hydraulic piston in a second position FIG. 9 shows a flow chart of a method for tensioning or replacing a saw chain on a guide bar of a motor saw.

The same reference numerals are used for same or corresponding parts throughout the drawings. For the purpose of this description and claims the terms "lengthwise" and "width" relate to the invention as described in FIG. 1, where the guide bar extends in a lengthwise direction from the motor saw motor unit and the support plate and clamping plate are arranged over the width of the guide bar. Any terms such as "upper", "lower", "top", "bottom", "downwards", "upwards" and any derivatives thereof relate to the invention as oriented in FIGS. 6A and 7B, respectively.

FIG. 1 shows a perspective view of a motor saw motor unit 1 where a support plate 2 is fixedly attached to the motor unit 1. To the support plate has been provided a guide bar 3 and a clamping plate 4. Fastening means 9,16 is used to detachably fasten the guide bar 3 and the clamping plate 4 to the support plate 2. The guide bar 3 is provided with a longitudinal slit 14, which can be used for displacing the guide bar 3 in a lengthwise direction towards and away from the motor saw motor unit 1.

In this description, the fastening means has been exemplified either as a threaded bolt or as a threaded bolt working together with a threaded nut. As will be understood by a person skilled in the art, also other types of fastening means, appropriate for use to keep the clamping plate and guide bar detachably fastened to the support plate, can be used such as for example different types of screws. The nuts have been exemplified as hexagonal nuts but can be varied and have any shape.

FIG. 2A shows a first embodiment of a support plate 2, which support plate 2 is provided with two through holes 5,6. In this first embodiment, one of the through holes 5 is used to fixedly attach the support plate 2 to the motor saw chassis or motor saw motor 1; and the second through hole 6 is used to hold the guide bar 3 and the clamping plate 4 in place using a fastening means 15 that can be detached, partly or as a whole. This is further described below with reference to FIG. 6A. The support plate 2 is further provided with two circular first recesses 7 at a distance from each other and arranged to the same longitudinal location with respect to the longitudinal direction of an attached guide bar. The through hole 5 is preferably centered, in a direction perpendicular to said longitudinal direction of said attached guide bar, between the two first recesses 7 and the second through hole 6 is preferably placed at a distance from the first through hole 5 in a lengthwise direction.

The support plate 2 is in general fixedly attached to the chassis of the motor saw or motor saw motor with at least one threaded nut through at least one of the through holes 5,6.

The support plate can further be provided with a second recess 8, arranged in the same lengthwise direction as through holes 5 and 6. From the through hole 5, the second through hole 6 may be arranged on one side of the through hole 5 and the second recess 8 on the opposite side of through hole 5, as shown in FIG. 2A.

The through holes 5, 6 and the second recess 8 is in this embodiment provided on an alignment means such as a countersunk rectangular third recess 20 centered between the two first recesses 7, as can be seen in FIG. 2A. The countersunk rectangular third recess 20 aligns the through holes 5,6 and the second recess to each other to make sure that they are in the correct position when the arrangement is to be mounted on a motor saw motor or motor saw chassis. The countersunk recess helps the stability of the arrangement when the motor saw is used.

FIG. 2B shows a cross-sectional view of a first embodiment of the support plate, where the two first recesses 7 can be seen as well as the second recess 8. The two first recesses 7 each comprises two recess parts, 7' and 7", which two parts have different diameters. The top part of each first recess 7' has a larger diameter than the bottom part 7", so that a shoulder is formed at the depth-direction intersection between the two parts 7', 7". Each top part 7' is adapted to be able to receive a projection on the clamping plate (see FIG. 4), while the bottom part 7" is adapted to be able to receive and accommodate a respective one of two fastening means, each insertable into one respective of said bottom parts 7", which is described in detail below with reference to the second embodiment of the support plate seen in FIG. 3.

Also shown in FIG. 2B is a space 21 wherein a hydraulic piston can be pushed, as further described with reference to FIGS. 8A and B.

FIG. 3 shows a second embodiment of the support plate 2, in a state in which two fastening means 9 have been attached in the two first recesses 7, so that the fastening means 9 fill out the respective bottom part 7" in question, while each top part 7' is still free to receive a respective projection of the clamping plate (see FIG. 4). In this embodiment the fastening means has been exemplified with at least partly threaded bolts working together with threaded nuts to achieve a clamping of the arrangement when the support plate and clamping plate is mounted with the guide bar between them. The fastening means 9 can preferably have a diameter of 25-30 mm to make the arrangement more stable, but also other diameters of the fastening means 9 are possible to use.

The support plate can further be provided with an alignment means 10, such as a raised, longitudinally oriented, rectangular projection, arranged to align and lock the support plate 2 in the width direction with the clamping plate 4. The alignment means 10 is preferably provided between the two first recesses 7 as seen in the width direction. In this second embodiment, the two through holes 5,6 and the second recess 8 is provided in the alignment means 10, which then replaces the countersunk part 20 described above with reference to FIG. 2A. The alignment means 10 is raised relative to the top part of the first recesses 7. The alignment means 10 aligns the through holes 5,6 and the second recess 8 to each other to make sure that they are in the correct position when the arrangement is to be mounted on a motor saw motor or motor saw chassis. The alignment means 10 cooperates with a longitudinal slit 14 on the guide bar 3 to hold the guide bar in the correct position.

The alignment means 10 may further engage with a spring means, which spring means can be provided on the clamping plate. It is preferably the second recess 8 on the alignment means 10 that is arranged to receive said spring means, described further with reference to FIG. 7C. The spring means can be used with any of the embodiments for the support plate. The spring means can in this entire description for example be a compression spring.

The alignment means 10 is provided to keep the guide bar 3 in place and specifically to align and lock the support plate 2 to both the clamping plate 4 and the guide bar 3 in the width direction, while providing certain relative freedom of motion between the said parts longitudinally as long as any threaded bolts and/or nuts have not been tightened.

It is realized that, in addition to the countersunk or projected part described above, the alignment means 10, 20 may have different geometric shapes as long as it fulfills its width-direction alignment and locking function as described above.

The second recess 8 is, provided to be able to receive a spring means, which can be attached to the clamping plate, which is described further below with reference to FIG. 7C.

FIG. 4 shows a perspective view of the clamping plate 4 from below. The clamping plate 4 is provided with two protrusions 11, one on each side of the clamping plate and a longitudinally oriented fourth recess 12 in the opposite direction between the protrusions. The protrusion 11 are adapted to fit inside the respective two first recesses 7 on the support plate when the clamping plate is attached to the support plate. The fourth recess 12 is adapted to be able to receive the alignment means 10 on the support plate 2 and the shapes of the fourth recess 12 and the alignment means 10 thus corresponds to each other.

The protrusions 11 have a shape, such as a selected size/diameter that conforms with the top part 7' of the first recesses 7, so that the protrusions 11 fit inside the first/top part of respective recess 7' in question when the clamping plate 4 is detachably attached to the support plate 2.

In the case where the support plate according to the first embodiment are to be used, the clamping plate must also be provided with a through hole in center of the fourth recess 12 so that a fastening means can be put through the fourth recess of the clamping plate and the longitudinal slit of the guide bar and into the through hole 5 on the support plate.

The motor saw assembly will be exposed to excessive forces during use, especially for motor saws of larger size and having coarser chains. The protrusions 11 increase the stability of the motor saw arrangement. It is therefore important that the protrusions 11 have a depth-direction height that exceeds a corresponding height of the guide bar 3 so that they are arranged to pass through the guide bar 3 and into the first recesses 7 a certain way when the arrangement is assembled.

The protrusions 11 should preferably have a height that is 4-10 mm larger than the thickness of the guide bar 3, preferably at least 4 mm, more preferably at least 5 mm larger than the height of the guide bar 3.

The clamping plate 4 has the task of clamping the guide bar 3 towards the support plate 2 and keep the whole arrangement safely attached to the motor saw chassis or motor saw motor, while allowing a certain longitudinal play when the fastening means are partly loosened as described below.

FIG. 5 shows a side view of a guide bar 3 for a motor saw. The guide bar can be detachably arranged between the support plate and the clamping plate. The guide bar is provided with two keyhole shaped slots 13 in the end of the guide bar that is closest to the chassis and motor part of the motor saw. Between the two keyhole-shaped slots 13 is provided a longitudinal slit 14 that is open in the end towards the drive sprocket.

The longitudinal slit 14 of the guide bar 3 makes it possible to adjust the guide bar in its lengthwise direction when the guide bar has been attached to the motor saw motor unit between the support plate and the clamping plate and the fastening means 15, 16 are partly loosened. The keyhole-shaped slots 13 makes it possible to adjust the guide bar 3 also when the second embodiment of the support plate 2 is used. When the guide bar is moved in the lengthwise direction towards the driving sprocket (not shown) the, at least partly, threaded bolts 9 on the clamping plate will move into the smaller part of the keyhole slot which gives an extra 10-20 mm, preferably 15 mm, in space for exchanging or loosening a chain from the guide bar.

A guide bar of a motor saw often wears unevenly during use and it is therefore also important to be able to easily loosen the guide bar and turning it 180 degrees around its own lengthwise axis so that the upper front part of the guide bar becomes the lower back part. In this way the guide bar can be used for a longer time without the need to completely exchange it. Therefore, it is preferred that the guide bar is symmetrical about a longitudinal symmetry line.

FIGS. 6A and 6B shows cross-sectional views of the arrangement comprising a support plate 2 according to the first embodiment, a guide bar 3 and a clamping plate 4. FIG. 6A shows the arrangement in a clamped position and FIG. 6B shows the arrangement in an open position where the guide bar can be pushed towards the drive sprocket or pulled away from the drive sprocket.

FIGS. 6A and 6B (as well as 7A and 7B) also shows the channel in the guide bar which holds the saw chain in place.

In FIG. 6A, showing the clamped position of the arrangement with the support plate according to a first embodiment, the two protrusions 11 on the clamping plate 4 are pushed down through the keyhole-shaped slots in the guide bar and further into the two first recesses 7 so that each top part 7' of each first recess 7 encircles a protrusion 11. A fastening means, which preferably is a partly threaded bolt, also called a clamping bolt, 15 is arranged to engage with a threaded hole 5 on the support plate 2 and to press the clamping plate 4 towards the support plate 2 with the guide bar 3 between them. The guide bar is clamped towards the support plate 2 and the motor saw chassis (not shown) and the motor saw can in this clamped position be used. The threaded bolt 15 can also be a threaded bolt that is fixedly attached to the support plate. In that case a threaded nut, also called a clamping bolt nut, must be attached to the top of the threaded bolt 15 after the guide bar and the clamping plate has been mounted, to achieve said pressing together of the support plate 2 to the clamping plate 4 with the guide bar 3 between them.

FIG. 6B shows an open position of the arrangement with the support plate according to a first embodiment, where the clamping plate 4 has been moved upwards away from the support plate 2. The threaded bolt has been partly unthreaded so that the protrusions 11 are outside the first recesses 7 and there is a distance between the support plate 2 and the clamping plate 4. When the arrangement is in this open position the guide bar can be pushed in, longitudinally, against the drive sprocket to change or adjust the saw chain, without the guide bar becoming loose and falling off.

FIGS. 7A, 7B and 7C shows cross-sectional views of the arrangement comprising a support plate 2 according to the second embodiment, a guide bar 3 and a clamping plate 4. FIGS. 7A and 7B shows the cross-sectional view as seen from the guide bar towards the drive sprocket of the motor saw, while FIG. 7C shows a cross sectional view as seen towards from the drive sprocket towards the guide bar. The support plate is provided with an alignment means 10, which preferably can be a raised longitudinal projection, which alignment means 10 comprises the threaded holes 5 and 6 and the second recess 8, as described above with reference to FIG. 3. The alignment means 10 fits in and engages with the longitudinal slit 14 on the guide bar and helps to hold the guide bar in position when the arrangement is in an open position. The alignment means 10 fits inside the rectangular fourth recess 12 on the clamping plate.

FIG. 7A shows the arrangement in a clamped position with the guide bar in a fixed position while FIGS. 7B and 7C shows the arrangement in an open position where the projections 11 have been pulled or pushed out of the first recesses 7 so that the guide bar can be pushed longitudinally towards the drive sprocket or pulled away longitudinally from the drive sprocket, without the whole guide bar becoming loose and falling off.

In FIG. 7A, showing the clamped position of the arrangement with the support plate according to a second embodiment, the two protrusions 11 on the clamping plate 4 are pushed down through the keyhole-shaped slots in the guide bar 3 and further into the two first recesses 7 so that each top part 7' of each first recess 7 encircles a respective protrusion 11. The threaded bolts 9 are each provided with a threaded nut 16 to engage with the threaded bolts 9 on the support plate 2 and to press the clamping plate 4 towards the support plate 2 with the guide bar 3 between them. The guide bar 3 is clamped towards the support plate 2 and the motor saw chassis (not shown) and the motor saw can in this clamped position be used.

FIG. 7B shows an open position of the arrangement with the support plate according to the second embodiment, where the clamping plate 4 has been moved upwards away from the support plate 2. The threaded nuts 16 have been partly undone from the threaded bolts 9 so that there is a distance between the support plate 2 and the clamping plate 4. Further, in case the threaded nuts 16 is completely undone and the clamping plate 4 removed, the guide bar 3 can be lifted upwards over the threaded bolts 9 to be completely loosened, for being turned as described above or replaced.

FIG. 7C shows the same open position of the arrangement as in FIG. 7*b*, with the support plate according to the said second embodiment, where the clamping plate 4 has been moved upwards away from the support plate 2 and wherein the clamping plate has further been provided with a spring means 17. The spring means automatically pushes the clamping plate away from the support plate when the threaded nuts 16 are loosened from the threaded bolts 9 without having been completely undone. This is an advantage, especially if the chain or guide bar needs to be adjusted when the user is in an area where parts can easily be lost, such as for example in the woods. There is no need to completely remove or disassemble any parts from the motor saw arrangement to change the chain or to loosen the guide bar. The spring means 17 is fixedly attached to the clamping plate 4 and will fit in the second recess 8 on the alignment means 10 on the support plate 2.

Although the spring means has only been shown on the clamping plate together with the support plate according to the second embodiment, the same spring means can also be used it is also possible to use the spring means on the clamping plate together with the support plate according to the first embodiment.

When assembling the motor saw arrangement according to the present invention, the guide bar 3 is placed on the support plate 2, which support plate 2 is already fixedly attached to the motor saw chassis or motor saw motor. The keyhole-shaped slots 13 of the guide bar 3 are placed over the first recesses 7, and for the second embodiment of the support plate, as shown in FIG. 3, the threaded bolts 9 go into the center of the larger circle-like portion of the keyhole-shaped slots 13. The longitudinal slit 14 of the guide bar is placed above the second recess 8 in the first embodiment of the support plate 2 and in the second embodiment of the support plate 2, the alignment means 10 on the support plate 2 fits inside the longitudinal slit 14 of the guide bar 3.

Most guide bars are provided with a slit for adjusting the position of the guide bar on the motor saw, but they are generally not open in the end that faces the drive sprocket, which means that it is necessary to completely remove all parts that hold the guide bar in position to be able to replace it. Using the arrangement according to the present invention it is not necessary to completely remove or disassemble any parts to be able to remove and replace the chain. If a support plate according to the first embodiment is used there is further not necessary to remove any parts to completely loosen the guide bar for turning it or exchange it as described above. The arrangement according to the present invention makes it easier to loosen the chain from the guide bar, which in turn makes it easier to turn the guide bar by loosening the threaded bolt 15 or the nuts 16 is partly unthreaded from the threaded bolts 9 enough to make it possible to pull the guide bar out in the lengthwise direction away from the driving sprocket. When the guide bar has been pulled so that the slit is completely loose, the guide bar can be turned over and then pushed back and the threaded bolt fastened.

The arrangement described above further makes it possible to tension the saw chain, for example by using pneumatics and then further by pushing the longitudinal slit 14 of the guide bar 3 in its lengthwise direction way from the drive sprocket of the motor saw. It is further possible, by using the arrangement according to the present invention, to temporarily loosen the tensioning of the saw chain without any need to redo the pneumatic tensioning. This will give the effect that it is possible to displace the guide bar up to 60 mm in its lengthwise direction towards the drive sprocket, as compared to a maximum of 30 mm for conventional arrangements of motor saws on the market today. The displacement of up to 60 mm is possible due to the combination of keyhole-shaped slots of the guide bar and the longitudinal slit of the guide bar. The possibility to achieve this displacement without the need to completely remove any parts is due to the design of the support plate and clamping plate together with the design of the guide bar as mentioned above.

FIGS. 8A and B shows a cross sectional view of the motor of the motor saw, in which a hydraulic chain stretcher is shown which comprises a hydraulic piston 18. The hydraulic piston can be pushed towards and away from the driving sprocket 19 to tension the saw chain of the motor saw in conventional way known to the person skilled in the art.

FIG. 8A shows a cross-sectional view of the motor of a motor saw, with the hydraulic piston 18 in a first position, exemplified with the distance a. In this first position the chain of the motor saw is fully tensioned.

FIG. 8B shows a cross-sectional view of the motor of a motor saw, with the hydraulic piston 18 in a second position, wherein the piston is now at a distance b which is smaller than distance a mentioned above. The hydraulic piston 18 displaces the guide bar in a lengthwise direction so that the saw chain is tensioned. There is now a distance c on the right side of the hydraulic piston 18. In this second position the chain of the motor saw is loosened and can be adjusted or removed by further pushing the guide bar 3 as far as possible towards the drive sprocket. For the second embodiment of the support plate, the threaded bolts 9 will in this position be pushed into the smaller part of the keyhole-shaped slots 13 of the guide bar 3. This will give up to an extra 30 mm displacement of the guide bar which is an advantage when a chain with higher pitch is used.

The possibility to displace the guide bar 3 up to 60 mm gives the advantage that the arrangement according to the present invention can be used on many different motor saws having different sizes of chains. It also makes it possible to change from a chain having a shorter drive link distance, such as a chain with a pitch of 0.404", to chains with a more robust and powerful chain with a larger drive link distance such as a chain having a pitch of ¾". A person skilled in the art understands that also chains with other pitch values can be used as long as they can be mounted on the guide bar with the arrangement according to the present invention.

FIG. 9 shows a flow chart of a method for removing or replacing a saw chain from a guide bar in a motor saw arrangement according to what has been described above. The method for removing or replacing the saw chain comprises the following steps:

a. partially detaching the clamping plate from the motor saw arrangement to release the guide bar;

b. displacing the guide bar in its longitudinal direction towards a driving sprocket on a motor saw motor unit; and c. detaching the saw chain from the guide bar.

In the first step, the clamping plate is partially detached from the support plate by loosening the fastening means, that is either the threaded bolt 15 from the threaded hole 5 or the threaded nuts 16 from the threaded bolts 9. After the bolt or nuts has been loosened it is possible to lift the clamping plate 4 away from the support plate 2 as shown in FIGS. 6B and 7B. If a spring means is used on the clamping plate, the spring means will push the clamping plate and support plate away from each other so that the guide bar can be displaced, as shown in FIG. 7C. In the second step, the guide bar can be displaced in its longitudinal direction towards a driving sprocket on a motor saw motor unit. This is possible due to the longitudinal slit 14 in the guide bar 3. When the guide bar has been displaced it is possible to detach the saw chain from the guide bar to replace it.

The general space needed to remove and replace a saw chain is up to about 30 mm. However, if a saw chain with a larger pitch is used, up to about 60 mm in space is needed to be able to remove and replace it. This is partially because the drive links gets worn and the chain will therefore become lengthened. The further displacement can be achieved by the present invention by further displacement of the guide bar towards the driving sprocket, which is possible due to the keyhole slots and the longitudinal slit on the guide bar 3.

The method can therefore comprise a further step:

d. displacing the guide bar 3 further towards the driving sprocket.

This further displacement can preferably be performed by using a hydraulic chain stretcher, which has been shown in FIG. 8A-B.

If a support plate according to the second embodiment is used, the threaded bolts 9 will during step d of the method be moved lengthwise into the smaller part of the keyhole-shaped slots in the guide bar when the guide bar 3 is displaced in its longitudinal direction towards the driving sprocket.

Above, preferred embodiments have been described. It is however apparent for the person skilled in the art that many modifications can be made to the disclosed embodiments without departing from the basic idea of the invention.

It is noted that the figures illustrate two of many possible detailed examples of an arrangement according to the present invention. However, many modifications may be made while still exploiting the principled elaborated and detailed above.

For instance, the spring means, the alignment means, and the fastening means may have different details than the ones described for exemplifying purposes.

Hence, the invention is not limited to the described embodiments, but can be varied within the scope of the enclosed claims.

The invention claimed is:

1. A motorized chain saw arrangement comprising a motor unit a support plate attached to the motor unit, a detachable clamping plate and a detachable guide bar arranged between the support plate and the clamping plate, wherein the support plate is provided with two first recesses and at least one threaded hole, the clamping plate provided with two protrusions adapted to fit inside the respective two first recesses when the clamping plate is attached to the support plate, the protrusions each having a height that exceeds a corresponding height of the guide bar and the guide bar being provided with two keyhole-shaped slots, and wherein the guide bar is further provided with a longitudinal slit arranged between the two keyhole-shaped slots and further wherein the support plate comprises an alignment structure.

2. The motorized chain saw arrangement according to claim 1, wherein the motorized chain saw arrangement is further provided with at least one fastener to press the clamping plate towards the support plate with the guide bar between them.

3. The motorized chain saw arrangement according to claim 2, the clamping plate is further provided with a spring, arranged to push the clamping plate away from the support plate when the at least one fastener is partially loosened.

4. The motorized chain saw arrangement according to claim 3, wherein the spring is a compression spring.

5. The motorized chain saw arrangement according to claim 4, the compression spring being arranged between the two protrusions.

6. The motorized chain saw arrangement according to claim 2, said fastener being a threaded bolt and the motorized chain saw arrangement is further provided with at least one bolt nut, arranged to achieve said pressing of the clamping plate towards the support plate.

7. The motorized chain saw arrangement according to claim 2, said fastener is a threaded bolt and the arrangement further comprises a threaded nut to achieve said pressing of the clamping plate towards the support plate with the guide bar between them.

8. The motorized chain saw arrangement according to claim 2, wherein the alignment structure engages with a spring of the motorized chain saw arrangement to achieve a raised position for the clamping plate when a fastener of the motorized chain saw arrangement is partly loosened.

9. The motorized chain saw arrangement according to claim 1, the support plate is provided with at least two fasteners, each arranged in the middle of a respective one of the two first recesses.

10. The motorized chain saw arrangement according to claim 1, the alignment structure on the support plate is a raised, longitudinally oriented, rectangular projection between the two first recesses and a further alignment structure is provided on the clamping plate to receive the raised rectangular projection once the clamping plate is attached to the support plate.

11. The motorized chain saw arrangement according to claim 10, wherein the alignment structure on the support plate engages with a longitudinal slit on the guide bar, to adjust the guide bar in its lengthwise direction.

12. A method to remove and/or replace a saw chain from a guide bar in a motorized chain saw arrangement comprising:

a. partially detaching a clamping plate by loosening fastening means from the motorized chain saw arrangement to allow spring force from spring means to move the clamping plate away from the guide bar;
b. displacing the guide bar in its longitudinal direction towards a driving sprocket on the motorized chain saw arrangement;
c. detaching the saw chain from the guide bar;
d. attaching a new saw chain on the guide bar; and
e. utilizing a hydraulic chain stretcher for displacing the guide bar further towards the driving sprocket.

* * * * *